US008584626B2

(12) United States Patent
Jacobi

(10) Patent No.: US 8,584,626 B2
(45) Date of Patent: Nov. 19, 2013

(54) PISTON FOR AN INTERNAL COMBUSTION ENGINE

(75) Inventor: Detlef Jacobi, Waiblingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 13/582,129

(22) PCT Filed: Mar. 2, 2011

(86) PCT No.: PCT/DE2011/000211

§ 371 (c)(1),
(2), (4) Date: Nov. 9, 2012

(87) PCT Pub. No.: WO2011/107079

PCT Pub. Date: Sep. 9, 2011

(65) Prior Publication Data

US 2013/0055969 A1 Mar. 7, 2013

(30) Foreign Application Priority Data

Mar. 2, 2010 (DE) ..... 10 2010 009 891

(51) Int. Cl.
*F01P 1/04* (2006.01)

(52) U.S. Cl.
USPC ..... 123/41.35; 123/41.34; 123/197.2; 123/193.1; 123/193.6; 92/176; 92/255

(58) Field of Classification Search
USPC ..... 123/41.34, 41.35, 193.1, 193.6, 197.2; 92/176, 255
See application file for complete search history.

(56) References Cited

U.S. PATENT DOCUMENTS

| | | | | |
|---|---|---|---|---|
| 1,089,823 | A | | 3/1914 | Day et al. |
| 1,405,887 | A | | 2/1922 | Alt |
| 2,214,891 | A | | 9/1940 | Schrom |
| 3,545,341 | A | | 12/1970 | Fischer |
| 4,013,047 | A | * | 3/1977 | Harned ..... 123/41.2 |
| 4,018,194 | A | * | 4/1977 | Mitchell et al. ..... 123/276 |
| 4,470,375 | A | * | 9/1984 | Showalter ..... 123/41.35 |
| 4,493,292 | A | * | 1/1985 | Showalter ..... 123/41.2 |
| 4,502,422 | A | * | 3/1985 | Brann ..... 123/41.35 |

(Continued)

FOREIGN PATENT DOCUMENTS

| | | |
|---|---|---|
| DE | 80 347 | 3/1971 |
| DE | 81 747 | 5/1971 |

(Continued)

OTHER PUBLICATIONS

International Search Report of PCT/DE2011/000211, Aug. 30, 2011.

(Continued)

*Primary Examiner* — Noah Kamen
*Assistant Examiner* — Grant Moubry
(74) *Attorney, Agent, or Firm* — Collard & Roe, P.C.

(57) ABSTRACT

The present invention relates to a piston (10, 110, 210) for an internal combustion engine, comprising a piston crown (13), a circumferential ring part (16), a circumferential cooling channel (27) arranged in the vicinity of the ring part (16), boss supports (21) connected below the piston crown (13), piston bosses (18) connected thereto, and a piston skirt (17). According to the invention, a cavity (28) closed on all sides and having a closure element (29, 129, 229) arranged in the direction of the piston skirt (17) is provided below the piston crown (13).

9 Claims, 3 Drawing Sheets

(56) References Cited

U.S. PATENT DOCUMENTS

Figure 1:
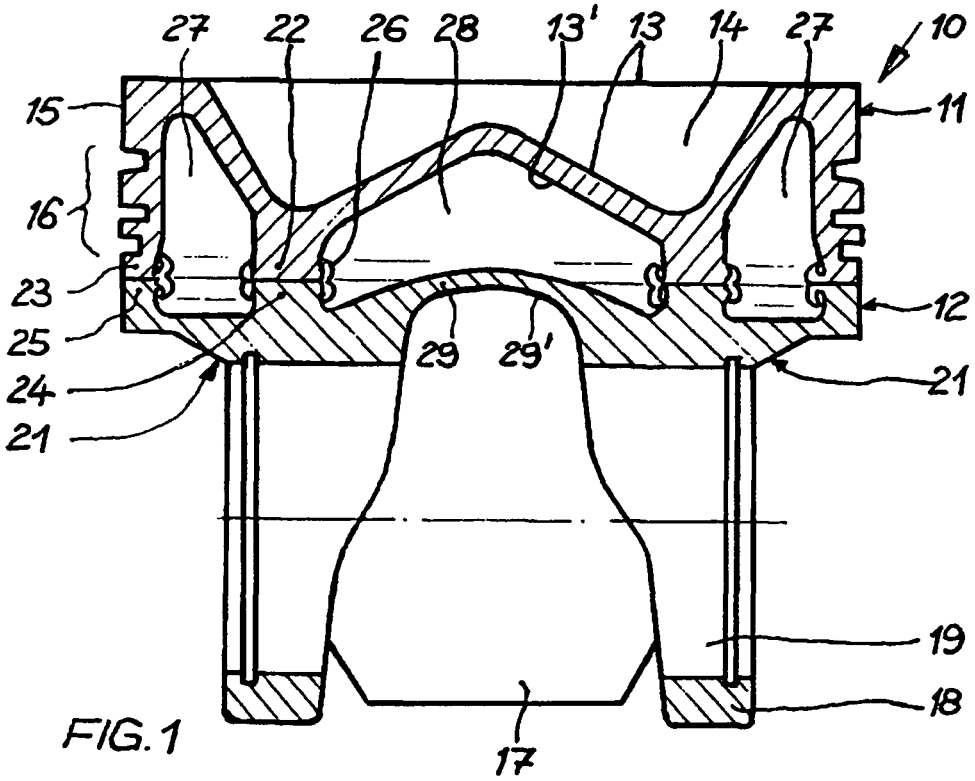

| | | | | |
|---|---|---|---|---|
| 4,662,319 | A * | 5/1987 | Ayoul | 123/41.35 |
| 5,081,968 | A * | 1/1992 | Bruni | 123/193.6 |
| 6,494,170 | B2 * | 12/2002 | Moloney et al. | 123/41.35 |
| 7,255,067 | B1 * | 8/2007 | Thorpe | 123/25 C |
| 7,654,240 | B2 * | 2/2010 | Jarrett et al. | 123/193.6 |
| 8,267,005 | B2 | 9/2012 | Scharp et al. | |
| 2010/0101527 | A1 | 4/2010 | Gniesmer | |
| 2010/0108001 | A1 * | 5/2010 | Scharp et al. | 123/41.35 |
| 2011/0155080 | A1 * | 6/2011 | Scharp | 123/41.35 |

FOREIGN PATENT DOCUMENTS

| | | |
|---|---|---|
| DE | 89 05 726 | 6/1990 |
| DE | 10 2005 030 556 | 1/2007 |
| DE | 10 2007 018 932 | 10/2008 |
| DE | 10 2008 055 911 | 5/2010 |
| EP | 0 469 666 | 2/1992 |
| FR | 690 997 | 9/1930 |
| FR | 2 088 887 | 1/1972 |
| GB | 2 129 523 | 5/1984 |
| JP | 63-147960 | 6/1988 |

OTHER PUBLICATIONS

German Search Report dated Jan. 10, 2011 in German Patent Application No. 10 2010 009 891.4 with English translation of relevant parts.

* cited by examiner

PISTON FOR AN INTERNAL COMBUSTION ENGINE

CROSS REFERENCE TO RELATED APPLICATIONS

This application is the National Stage of PCT/DE2011/000211 filed on Mar. 2, 2011, which claims priority under 35 U.S.C. §119 of German Application No. 10 2010 009 891.4 filed on Mar. 2, 2010, the disclosure of which is incorporated by reference. The international application under PCT article 21(2) was not published in English.

The present invention relates to a piston for an internal combustion engine, which has a piston crown, a circumferential ring belt, a circumferential cooling channel in the region of the ring belt, pin boss supports connected below the piston crown, and pin bosses connected with them, as well as a piston skirt.

During operation of internal combustion engines, lubricant oil drops from the crankcase come into contact with the hot underside of the piston crown. In this connection, the lubricant oil evaporates, whereby the evaporated lubricant oil particles are all the smaller, the hotter the underside of the piston crown. Furthermore, the lubricant oil ages all the way to coking and to formation of an oil carbon layer on the underside of the piston crown. This process furthermore brings about the result that the oil change intervals are shortened, proportional to the aging of the lubricant oil.

The lubricant oil particles that come from the crankcase flow past the piston, in known manner, together with the leakage flow, into the crankcase (so-called "blow-by gases"), into an oil mist precipitator, in which they are precipitated, at least in part, so that the purified blow-by gas can be passed back to the combustion air in the engine. The degree of precipitation significantly depends on the size of the lubricant oil particles. The smaller the particle size, i.e. the hotter the underside of the piston crown, the more complicated the design of the oil mist precipitator needs to be.

The task of the present invention consists in making available a piston in which the lubricant oil aging is at least delayed, and the degree of precipitation of the lubricant oil particles in the oil mist precipitator is improved.

The solution consists in that a cavity closed off all around, having a closure element disposed in the direction of the piston skirt is provided below the piston crown.

The principle on which the present invention is based consists in reducing the surface temperature of the piston components with which the lubricant oil that comes from the crankcase comes into contact. For this purpose, a cavity closed off all around is provided below the piston crown, according to the invention. This particularly means that no cooling oil channels are provided between the circumferential cooling channel and the cavity, and that cooling of the piston according to the invention takes place exclusively by way of the circumferential cooling channel, by means of cooling oil that is passed in and out. The cavity provided according to the invention brings about heat insulation with regard to the hot underside of the piston crown, because of the air that is enclosed in it. For this reason, the closure element has a clearly lower surface temperature than the underside of the piston crown.

The lubricant oil that comes from the crankcase now does not have any direct contact with the hot underside of the piston crown, but rather impacts on the underside of the closure element, which is clearly cooler. The lubricant oil particles that are formed in this connection are significantly larger because of the lower temperatures, so that the precipitation rate in the oil mist precipitator is significantly improved, and a complicated design of the oil mist precipitator is avoided. Because of the lower temperatures, aging of the lubricant oil is clearly delayed, and the formation of oil carbon is avoided.

The present invention is suitable for all piston types, i.e. for one-part and multi-part pistons, as well as for pistons having a low construction height. The piston according to the invention is characterized by great stability, because cooling oil channels, which have a destabilizing effect as locations of the greatest stress concentration, are not provided. The closure element itself furthermore improves the strength of the piston structure, by means of an additional reinforcement.

Advantageous further developments are evident from the dependent claims.

The closure element provided according to the invention can be configured in one piece with the piston. A closure wall configured in one piece with the pin boss supports of the piston is preferred. However, the closure element provided according to the invention can also be configured as a separate component, particularly as a single-walled or double-walled closure body. The selection of the closure element essentially depends on the piston type used, so that broad variation possibilities exist in the elaboration of the present invention.

The double-walled closure body preferably encloses a chamber that acts as additional heat insulation with regard to the underside of the piston crown. The double-walled closure body itself can be configured in one part or two parts.

The closure wall or the closure body is preferably connected with the piston in the region of the pin boss connections of the latter, so that a particularly large cavity, closed off all around, is formed, which cavity forms particularly effective heat insulation with regard to the underside of the piston crown.

It is practical if the closure element in the form of a separate component is held in the piston under spring bias. In this case, in particular, the closure element can be configured as a spring-elastic component, at least in part.

The closure element in the form of a separate component is preferably held in an accommodation element provided in the piston, and is therefore fixed in place particularly securely during engine operation.

The closure element in the form of a separate component can be produced from any desired material, whereby a spring steel sheet has proven to be well suitable.

The piston according to the invention can be configured as a one-part piston, for example a cast piston. The piston according to the invention can furthermore be configured as a multi-part piston, for example composed of an upper piston part and a lower piston part. The components can be cast parts or forged parts, for example, and can be produced from a steel material, for example, particularly forged. The connection between the components can take place in any desired manner. Welding, particularly friction-welding, is a particularly suitable joining method.

Figure 2:
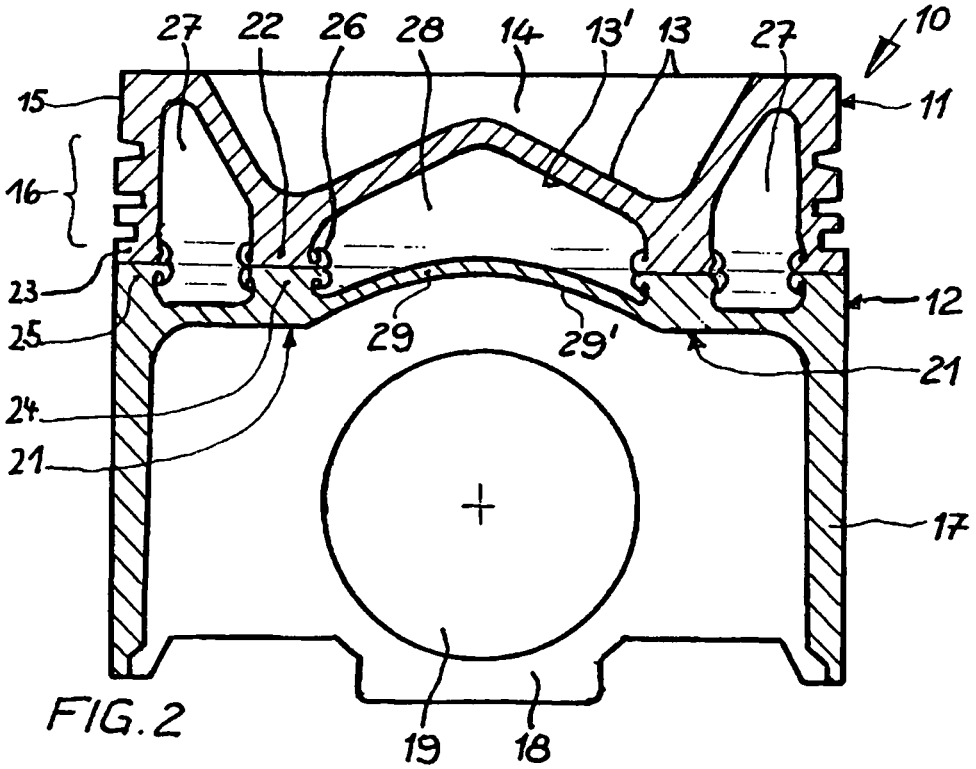
Figure 3:
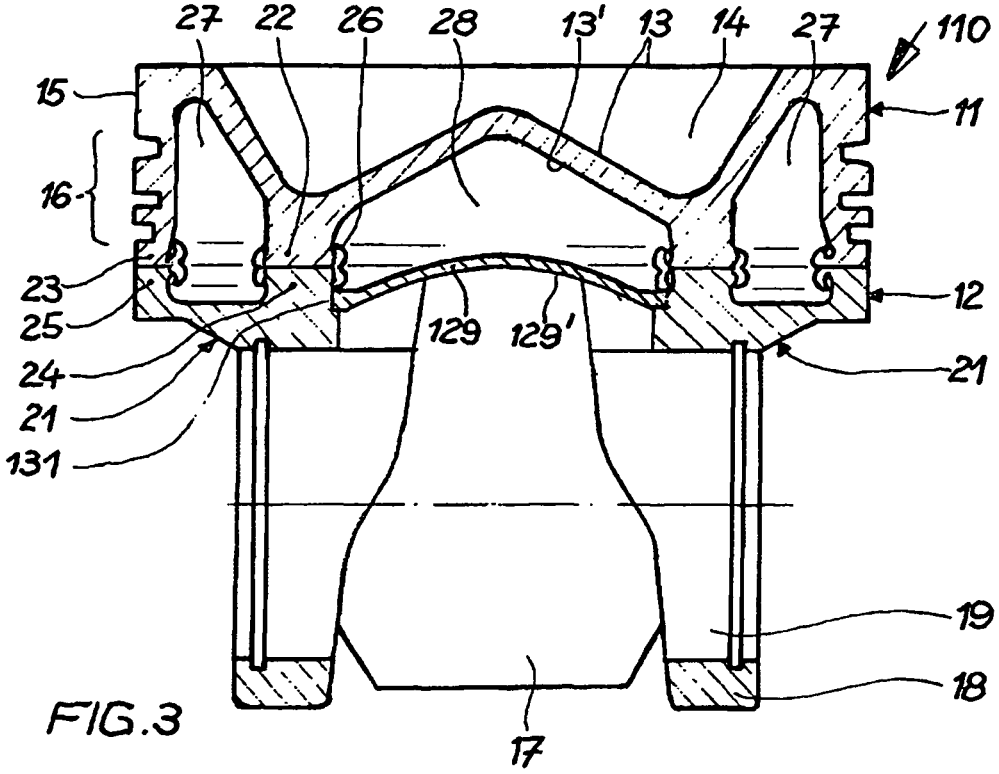
Figure 4:
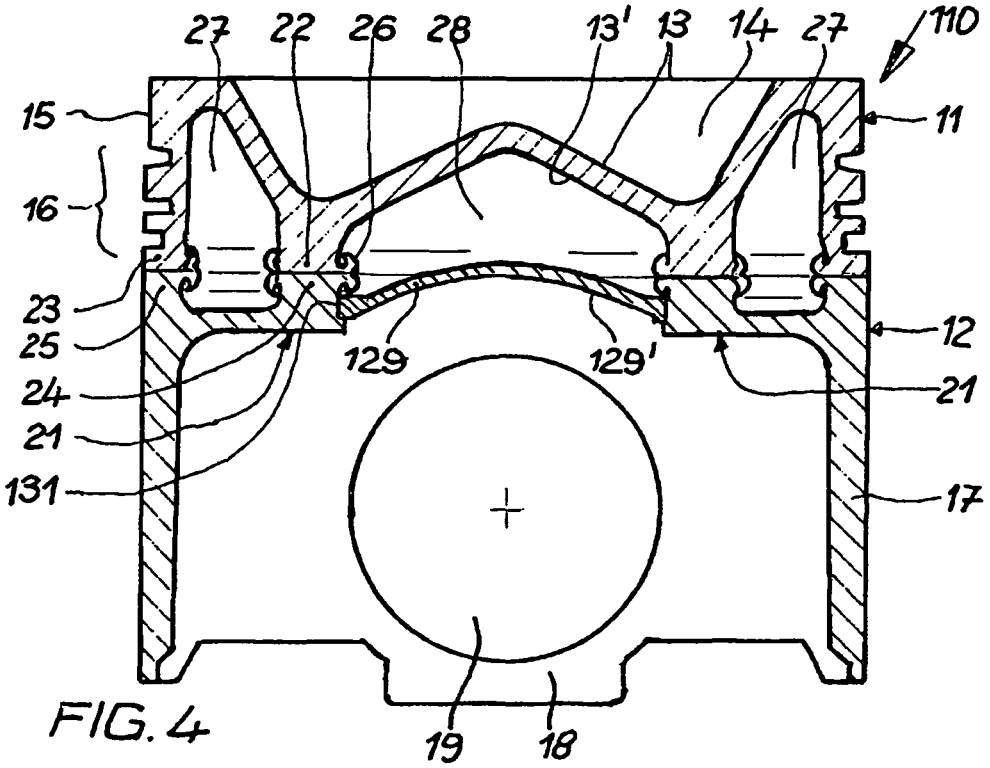
Figure 5:
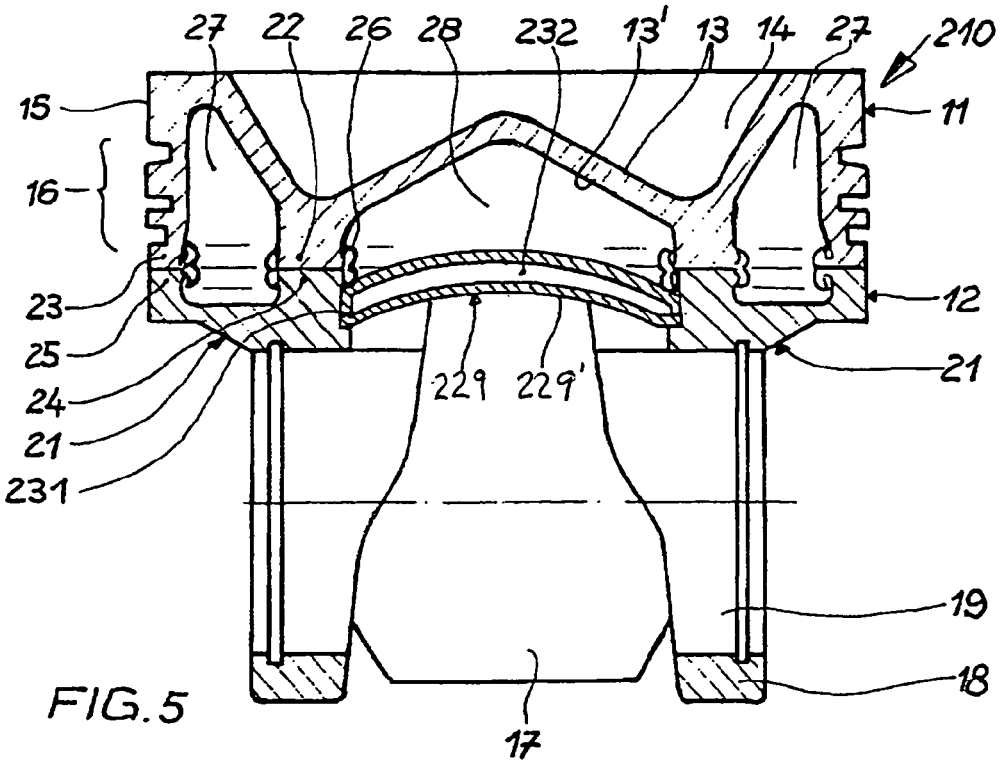
Figure 6:
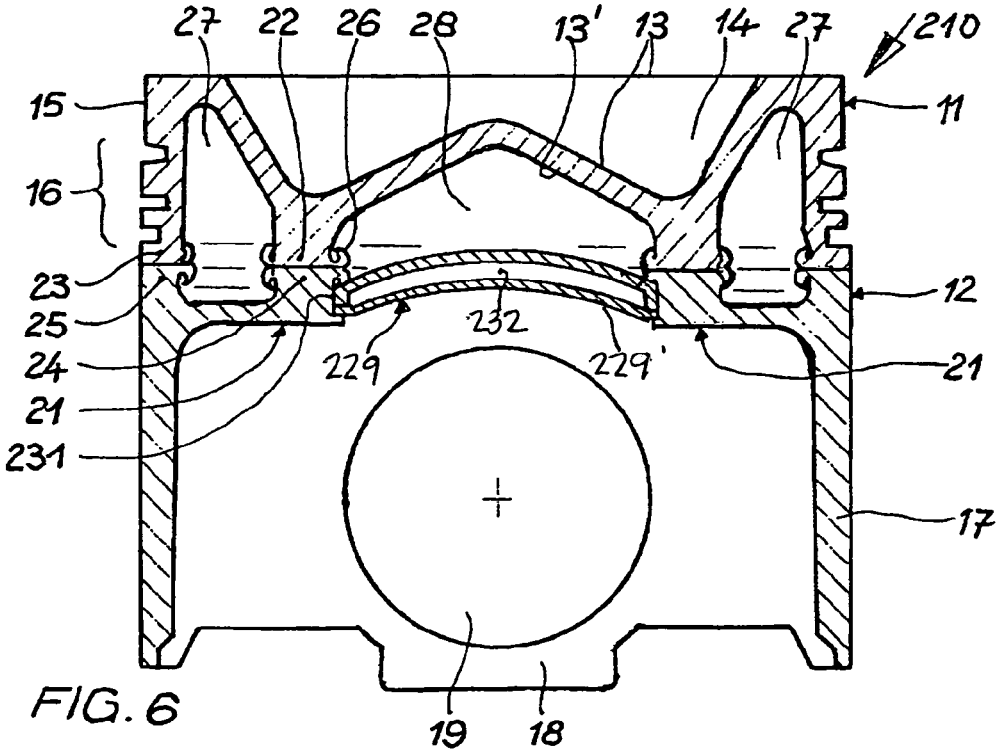

Exemplary embodiments of the present invention will be explained in greater detail below, using the attached drawings. These show, in a schematic representation, not true to scale:

FIG. 1 a section through a first exemplary embodiment of a piston according to the invention;

FIG. 2 the piston according to FIG. 1 in section, whereby the representation is rotated by 90° relative to FIG. 1;

FIG. 3 a section through another exemplary embodiment of a piston according to the invention;

FIG. 4 the piston according to FIG. 3 in section, whereby the representation is rotated by 90° relative to FIG. 3;

FIG. 5 a section through another exemplary embodiment of a piston according to the invention;

FIG. 6 the piston according to FIG. 5 in section, whereby the representation is rotated by 90° relative to FIG. 3.

In the following, the present invention will be described using a two-part piston consisting of an upper part and a lower part. Of course, the present invention can also be implemented with other piston types, such as, for example, one-part pistons or articulated pistons.

FIGS. 1 and 2 show a first exemplary embodiment of a piston 10 according to the invention, in the form of a box piston. The piston 10 is composed of an upper piston part 11 and a lower piston part 12, which are forged from a steel material in the exemplary embodiment. The upper piston part 11 has a piston crown 13 having a combustion bowl 14 as well as a circumferential top land 15 and a circumferential ring belt 16. The lower piston part 12 has a piston skirt 17 as well as pin bosses 18 having pin bores 19 for accommodation of a piston pin (not shown). The pin bosses 18 are connected with the underside 13' of the piston crown 13 by way of pin boss supports 21.

The upper piston part 11 has an inner circumferential support element 22 and an outer circumferential support element 23. The inner support element 22 is disposed to run circumferentially in ring shape on the underside of the piston crown 13. The outer support element 23 is configured below the ring belt 16 in the exemplary embodiment.

The lower piston part 12 also has an inner circumferential support element 24 and an outer circumferential support element 25. The inner support element 24 is disposed circumferentially on the top of the lower piston part 12. The outer support element 25 is configured as an extension of the piston skirt 17 in the exemplary embodiment. The pin boss supports 21 are configured below the inner support element 25 in the exemplary embodiment.

The upper piston part 11 and the lower piston part 12 can be joined in any desired manner, whereby the corresponding outer and inner support elements of upper piston part 11 and lower piston part 12 are connected with one another. In the exemplary embodiment, the known friction-welding method was selected, as is evident in FIGS. 1 and 2 from the friction-welding beads 26.

The upper piston part 11 and the lower piston part 12 form a circumferential cooling channel 27. In this connection, the ring belt 16 and the outer support element 23 of the upper piston part 11 as well as the outer support element 25 of the lower piston part 12 delimit the cooling channel 27 toward the outside. The inner support element 22 of the upper piston part 11 and the inner support element 24 of the lower piston part 12 delimit the cooling channel 27 toward the piston interior. The inner support element 22 of the upper piston part 11 and the inner support element 24 of the lower piston part 12 furthermore delimit a cavity 28 that is essentially disposed below the piston crown 13.

The cavity 28 is closed off all around, in other words the inner support elements 22, 24 of the upper piston part 11 and the lower piston part 12 do not have any openings such as cooling oil channels, for example. In order to close the cavity 28 in the direction of the piston skirt 17 and the piston pin bosses 18, a closure element 29 is provided. In the exemplary embodiment, the closure element 29 is a closure wall configured in one piece with the lower piston part 12, which wall is connected with the lower piston part 12, in one piece, in the region of the pin boss supports 21, so that no lubricant oil can penetrate into the cavity 28 out of the crankcase and no cooling oil can penetrate into it out of the cooling channel 27. The cavity 28, which is closed off all around, acts as heat insulation with regard to the underside 13' of the piston crown 13 in the region of the combustion bowl 14, which underside is hot during operation. The lubricant oil that comes out of the crankcase during engine operation impacts the underside 29' of the closure element 29, which is significantly cooler than the underside 13' of the piston crown 13. The lubricant oil particles that are formed during this process are significantly larger because of the lower temperatures, so that the precipitation rate in the oil mist precipitator is significantly improved and a complicated design of the oil mist precipitator is avoided. Aging of the lubricant oil is clearly delayed because of the lower temperatures, and the formation of oil carbon is avoided.

FIGS. 3 and 4 show another exemplary embodiment of a piston 110 according to the invention, which corresponds almost entirely to the piston 10 according to FIGS. 1 and 2 in terms of its structure. For this reason, the reference symbols were kept the same, for reasons of simplicity, and reference is made to the description relating to FIGS. 1 and 2.

The essential difference as compared with the piston 10 according to FIGS. 1 and 2 consists in that in the piston 110, the closure element 129 is configured as a separate component, in the form of a closure body. The closure element 129 is produced from a spring steel sheet in the exemplary embodiment, having a thickness of approximately 0.8 mm and provided with a slight curvature in the direction of the piston crown 13, thereby producing a bias. In the exemplary embodiment, the closure element 129 is held in the lower piston part 12, in the region of the pin boss supports 21, under spring bias. For this purpose, an accommodation means 131 in the form of a circumferential depression having a depth of about 0.5 mm is formed in, in the region of the pin boss supports 21, in the exemplary embodiment, in which depression the closure element 129 is accommodated and held.

The upper piston part 11 and the lower piston part 12 of the piston 110 according to FIGS. 3 and 4 are connected with one another by means of friction-welding in the exemplary embodiment. For assembly of the piston 110 according to the invention, first the upper piston part 11, the lower piston part 12, and the closure element 129 are produced as separate components. In the exemplary embodiment, an accommodation means 131 in the form of a circumferential depression having a depth of about 0.5 mm is formed in, in the region of the pin boss supports 21 of the lower piston part 12, for example by means of chip-removing machining. In the exemplary embodiment, the closure element 129 is inserted into the lower piston part 12 in the region of the pin boss supports 21, and held in the accommodation means 131 there under spring bias. Subsequently, the upper piston part 11 and the lower piston part 12 are connected with one another by means of friction-welding. The friction-welding beads 26 that occur in this connection serve as additional holders of the closure element 129 in the axial direction.

The closure element 129 is held in the lower piston part 12 in liquid-tight manner, so that the cavity 28 formed below the piston crown 13 is closed off all around, so that no lubricant oil can penetrate into the cavity 28 from the crankcase, and no cooling oil can penetrate into it the from cooling channel 27. The cavity 28, which is closed off all around, acts as heat insulation with regard to the underside 13' of the piston crown 13 in the region of the combustion bowl 14, which underside is hot during operation. The lubricant oil that comes out of the crankcase during engine operation impacts the underside 129' of the closure element 129, which is significantly cooler than the underside 13' of the piston crown 13. The lubricant oil particles that are formed during this process are significantly larger because of the lower temperatures, so that the precipitation rate in the oil mist precipitator is significantly improved and a complicated design of the oil mist precipitator is avoided. Aging of the lubricant oil is clearly delayed because of the lower temperatures, and the formation of oil carbon is avoided.

FIGS. 5 and 6 show another exemplary embodiment of a piston 210 according to the invention, which corresponds almost entirely to the piston 10 according to FIGS. 1 and 2 in terms of its structure. For this reason, the reference symbols were kept the same, for reasons of simplicity, and reference is made to the description relating to FIGS. 1 and 2.

The essential difference as compared with the piston 10 according to FIGS. 1 and 2 and with the piston 110 according to FIGS. 3 and 4 consists in that in the piston 210, the closure element 229 is configured as a separate component, in the form of a double-walled closure body. The closure element 229 is configured in two parts in the exemplary embodiment, but a one-part configuration is also possible, of course. The two components of the closure element 229 are produced from a spring steel sheet in the exemplary embodiment, connected with one another by means of welding, and provided with a slight curvature in the direction of the piston crown 13, thereby producing a bias. In the exemplary embodiment, the two components of the closure element 229 enclose a chamber 232, which is filled with air in the exemplary embodiment, and acts as additional heat insulation. In the exemplary embodiment, the closure element 229 is also held in the lower piston part 12, in the region of the pin boss supports 21, under spring bias. For this purpose, an accommodation means 231 in the form of a circumferential depression having a depth of about 0.5 mm is formed in, in the region of the pin boss supports 21, in the exemplary embodiment, in which depression the closure element 229 is accommodated and held.

The upper piston part 11 and the lower piston part 12 of the piston 210 according to FIGS. 5 and 6 are connected with one another by means of friction-welding in the exemplary embodiment. For assembly of the piston 210 according to the invention, first the upper piston part 11, the lower piston part 12, and the closure element 229 are produced as separate components. In the exemplary embodiment, an accommodation means 231 in the form of a circumferential depression having a depth of about 0.5 mm is formed in, in the region of the pin boss supports 21 of the lower piston part 12, for example by means of chip-removing machining. In the exemplary embodiment, the closure element 229 is inserted into the lower piston part 12 in the region of the pin boss supports 21, and held in the accommodation means 231 there under spring bias. Subsequently, the upper piston part 11 and the lower piston part 12 are connected with one another by means of friction-welding. The friction-welding beads 26 that occur in this connection serve as additional holders of the closure element 229 in the axial direction.

The closure element 229 is held in the lower piston part 12 in liquid-tight manner, so that the cavity 28 formed below the piston crown 13 is closed off all around, so that no lubricant oil can penetrate into the cavity 28 from the crankcase, and no cooling oil can penetrate into it the from cooling channel 27. The cavity 28, which is closed off all around, acts as heat insulation with regard to the underside 13' of the piston crown 13 in the region of the combustion bowl 14, which underside is hot during operation. The lubricant oil that comes out of the crankcase during engine operation impacts the underside 229' of the closure element 229, which is significantly cooler than the underside 13' of the piston crown 13. The lubricant oil particles that are formed during this process are significantly larger because of the lower temperatures, so that the precipitation rate in the oil mist precipitator is significantly improved and a complicated design of the oil mist precipitator is avoided. Aging of the lubricant oil is clearly delayed because of the lower temperatures, and the formation of oil carbon is avoided.

The invention claimed is:

1. A piston for an internal combustion engine, which has a piston crown, a circumferential ring belt, a circumferential cooling channel in the region of the ring belt, pin boss supports connected below the piston crown, and pin bosses connected with them, as well as a piston skirt, wherein a cavity closed off all around, having a closure element disposed in the direction of the piston skirt is provided below the piston crown, wherein the closure element is configured as a double-walled closure body, and wherein the double-walled closure body encloses a chamber.

2. The piston according to claim 1, wherein the double-walled closure body is configured in one part or two parts.

3. The piston according to claim 1, wherein the closure element is configured as a closure body held in the region of the pin boss connections of the piston.

4. The piston according to claim 1, wherein the closure element is held in the piston under spring bias.

5. The piston according to claim 1, wherein the closure element is configured as a spring-elastic component, at least in part.

6. The piston according to claim 1, wherein the closure element is held in an accommodation means provided in the piston.

7. The piston according to claim 1, wherein the closure element is produced from a spring sheet steel.

8. The piston according to claim 1, wherein the piston is configured as a one-part piston.

9. The piston according to claim 1, wherein the piston is configured as a multi-part piston.

* * * * *